US011439547B2

(12) United States Patent
Lindberg

(10) Patent No.: US 11,439,547 B2
(45) Date of Patent: Sep. 13, 2022

(54) APPARATUS AND METHOD FOR IMPROVING STANDING SITTING STANDING OF PERSONS WITH MOBILITY ISSUE

(71) Applicant: John Lindberg, Hampstead, NH (US)

(72) Inventor: John Lindberg, Hampstead, NH (US)

( * ) Notice: Subject to any disclaimer, the term of this patent is extended or adjusted under 35 U.S.C. 154(b) by 0 days.

(21) Appl. No.: 16/932,971

(22) Filed: Jul. 20, 2020

(65) Prior Publication Data

US 2021/0022935 A1 Jan. 28, 2021

Related U.S. Application Data

(60) Provisional application No. 62/879,506, filed on Jul. 28, 2019.

(51) Int. Cl.
*A61G 5/14* (2006.01)
*A61G 7/10* (2006.01)

(52) U.S. Cl.
CPC ..... *A61G 5/14* (2013.01); *A61G 7/1017* (2013.01); *A61G 7/1038* (2013.01)

(58) Field of Classification Search
CPC ..... A61G 5/14; A61G 7/1017; A61G 7/1038
See application file for complete search history.

(56) References Cited

U.S. PATENT DOCUMENTS 2,757,388 A * 8/1956 Chisholm ..... A61G 7/1038 5/507.1
3,310,817 A * 3/1967 Harding ..... A61G 7/0533 5/662
6,961,967 B1 * 11/2005 Brown ..... A61G 7/053 135/84

* cited by examiner

*Primary Examiner* — Peter M. Cuomo
*Assistant Examiner* — Adam C Ortiz
(74) *Attorney, Agent, or Firm* — Isus Intellectual Property PLLC; Anthony Jason Mirabito

(57) ABSTRACT

An apparatus that is configured to assist a helper to move a seated person from a first, seated position to a second, standing position, includes a lifting/assisting device, the lifting/assisting device being comprised of: a rigid elongated member, the elongated member having a longitudinal axis, a first proximal end and a second distal end, the first proximal end being adapted for being positioned on a floor; an offset section, the offset section being offset from the longitudinal axis a distance X and being located along the elongated member between the first proximal end and the second distal end; and, a lateral grasping member for the person, the grasping member being positioned distally of the offset section; a second offset member, the second offset member being of a dimension to approximately match the first offset section; and, a grab member positioned distally of the second offset member for use by the helper.

2 Claims, 7 Drawing Sheets

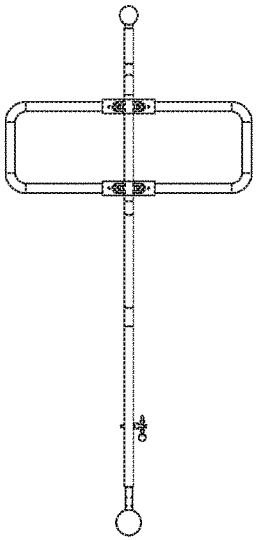
FIG. 6A
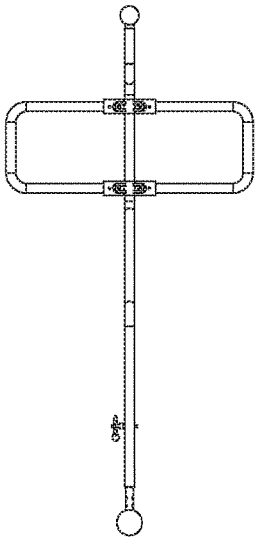
FIG. 6B
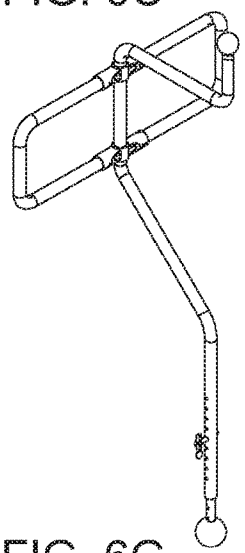
FIG. 6C
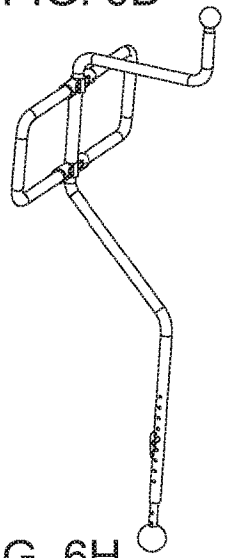
FIG. 6D
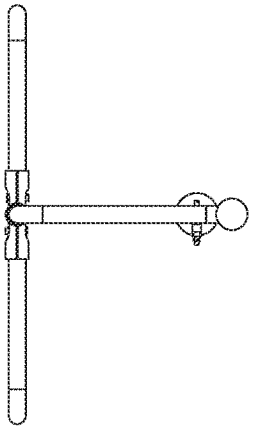
FIG. 6E
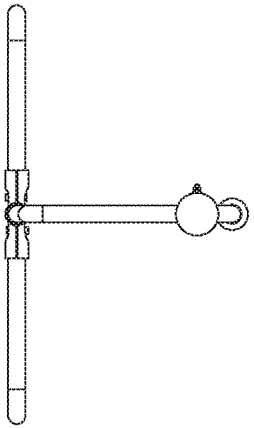
FIG. 6F
FIG. 6G
FIG. 6H

APPARATUS AND METHOD FOR IMPROVING STANDING SITTING STANDING OF PERSONS WITH MOBILITY ISSUE

RELATED APPLICATION

This application claims the benefit and priority to U.S. Provisional Application No. 62/879,506, filed Jul. 28, 2019, the entire disclosure of which is hereby incorporated by reference.

FIELD OF THE INVENTION

The present invention relates to mobility aids for persons with mobility problems, particularly those persons who have difficulty standing from a seated position and vice versa.

BACKGROUND OF THE PRESENT INVENTION

The inability of some persons to get up from a seated position to a standing position and then from a standing position to a seated position has been and continues to be a problem with people at a variety of ages.

This problem is less of a problem when the person has a helper or aid to assist in moving the person from one position to another and/or when there is some sort of aid device to assist the person. One example is a set or rails that attach to or are placed in close proximity to a commode so as to allow the person to sit down than get up after finishing with his/her toilet. Another example is a common cane which may be used to help the person stand/sit.

Yet another example is a two-person assist device or aid such as is shown and described in U.S. Pat. No. 6,961,967, shown in FIG. 1 herein. In such patent, a straight cane like device is shared between the aid/helper and the seated person. This device is designed to facilitate the standing or seating of person who cannot themselves move from one position to another alone or who at least have difficulty doing so. However, even this device may be inadequate for lifting/assisting heavy persons or very immobile persons, or person who have standing stability problems. If the aid/helper is of slighter build or of a weaker nature, lifting/assisting the person from, for example, a seated to a standing position may be difficult and cause instability of the person being lifted/assisted, potentially causing the person to fall, which may cause injuries both to the person and to helper/aid.

Thus, there is a felt need for a device which eases the forces needed to help a person stand or be seated and well as provide a more stable device which assists in keeping the person stable when transitioning to a standing position and vice versa. It is to respond to this challenge that the present invention is directed.

SUMMARY OF THE PRESENT INVENTION

In an aspect, the present invention includes a method of moving a person from a first, seated position to a second, standing position, with the assistance of a helper, the method comprising the steps of: providing a lifting/assisting device, the lifting/assisting device being comprised of: a rigid elongated member, the elongated member having a longitudinal axis, a first proximal end and a second distal end, the first proximal end being adapted for being positioned on a floor; an offset section, the offset section being offset from the longitudinal axis a distance X and being located along the elongated member between the first proximal end and the second distal end; a lateral grasping member for the person, the grasping member being positioned distally of the offset section; a second offset member, the second offset member being of a dimension to approximately match the first offset section; and, a grab member positioned distally of the second offset member for use by the helper. Further, the method includes: first, positioning the proximal end of the device on the floor in front of the person to be moved from a seated position, with the offset being directed to the seated person; next, positioning the helper behind the device, such that the device is positioned between the seated person and the helper; next, the seated person grasping the lateral grasping member; next, the helper grasping the grab member; and, next, the helper exerting a force to move the elongated member in a direction away from the seated person and pivoting about the first proximal end of the device; wherein continued movement of the elongated member raises the seated person from a seated position to a standing position.

In another aspect, the present invention includes an apparatus configured to assist a helper to move a seated person from a first, seated position to a second, standing position; the apparatus comprises: a lifting/assisting device, the lifting/assisting device being comprised of: a rigid elongated member, the elongated member having a longitudinal axis, a first proximal end and a second distal end, the first proximal end being adapted for being positioned on a floor; an offset section, the offset section being offset from the longitudinal axis a distance X and being located along the elongated member between the first proximal end and the second distal end; and, a lateral grasping member for the person, the grasping member being positioned distally of the offset section; a second offset member, the second offset member being of a dimension to approximately match the first offset section; and, a grab member positioned distally of the second offset member for use by the helper.

BRIEF DESCRIPTION OF THE DRAWINGS

FIGS. 6A through 6H illustrates an additional eight views of the present invention shown in FIGS. 2A through 2C.

DETAILED DESCRIPTION OF THE PRESENT INVENTION

Figure 1B:
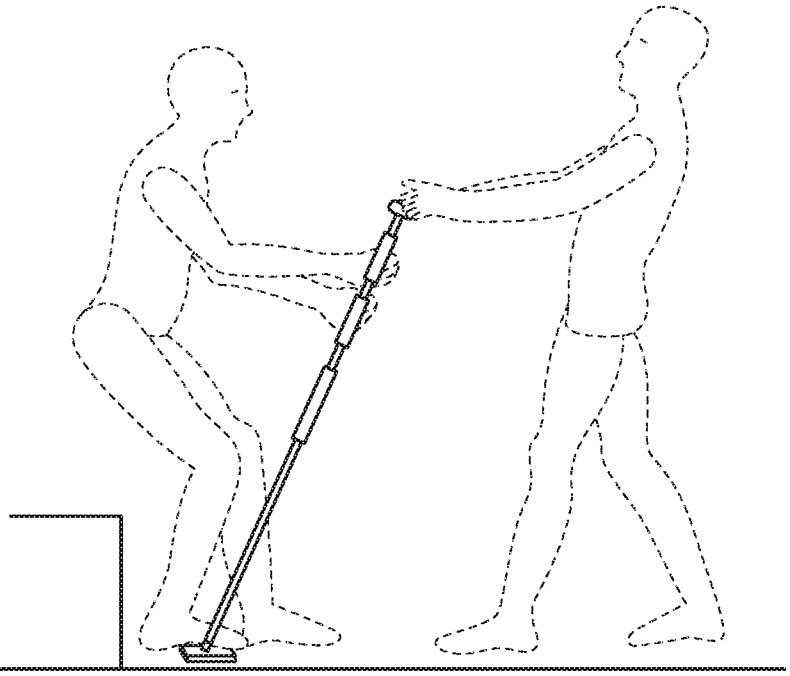
FIG. 1B (PRIOR ART)
FIGS. 1A and 1B illustrate a prior art device.
Figure 1A:
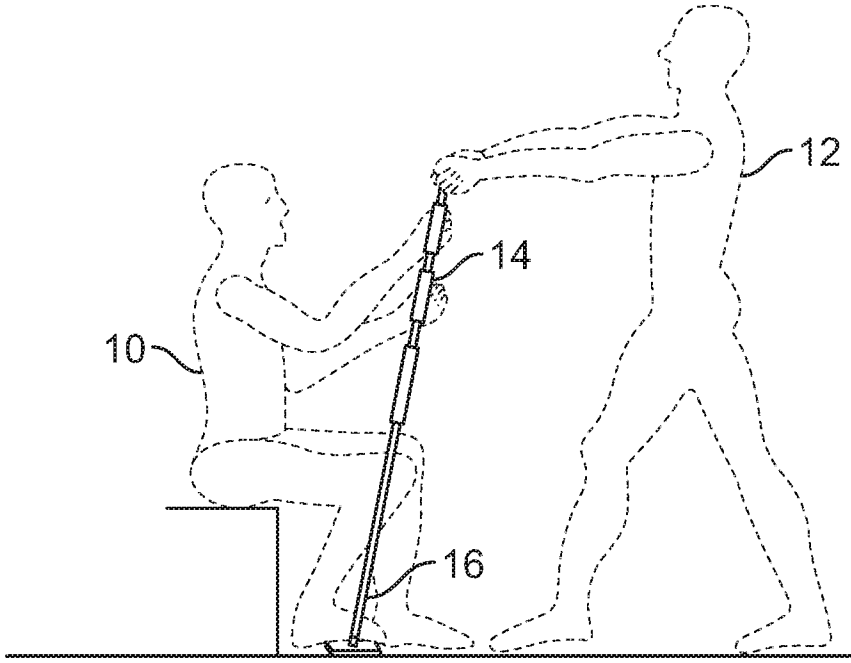
FIG. 1A (PRIOR ART)

As mentioned, one prior art device upon which the present invention is an improvement is that shown in FIGS. 1A and 1B.

While this prior art device facilitates an aide/helper assisting the seated person shown in FIG. 1A from moving from the position of FIG. 1A to that of FIG. 1B, the arrangement is far from ideal as it does not use leverage forces to the best advantage nor does it provide for lateral stability. The latter is shown by the arrangement in which the hands of both the seated person 10 and the helper 12 are engaging the upper portion 14 of the shaft 16 of the device. By only providing the vertically-disposed shaft 14 for both the person seated and the helper to grip, this would likely result in lateral instability, further exacerbated by the relative instability of the seated person when being moved to a standing position.

Figure 2C:
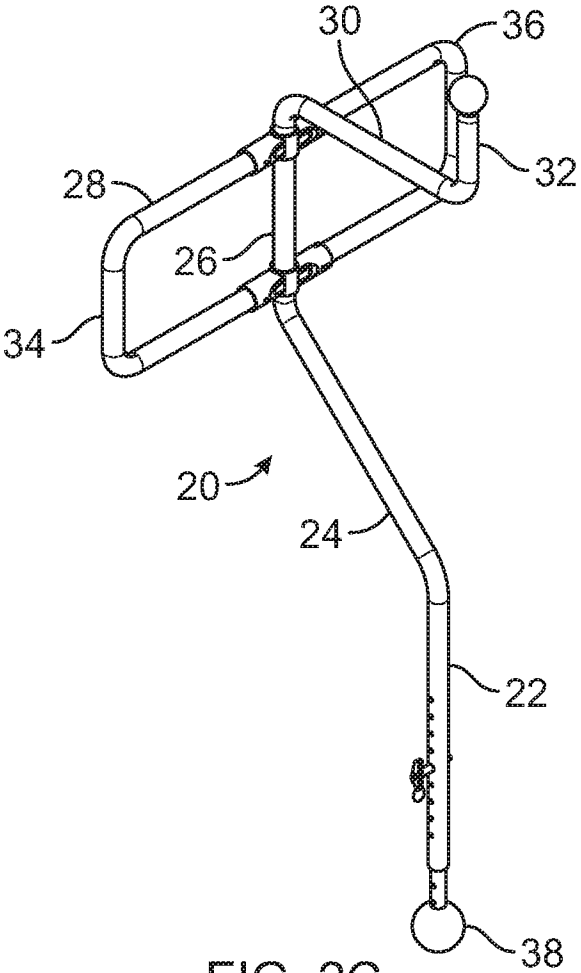
FIGS. 2A through 2C illustrate various views of the device of the present invention.
Figure 2B:
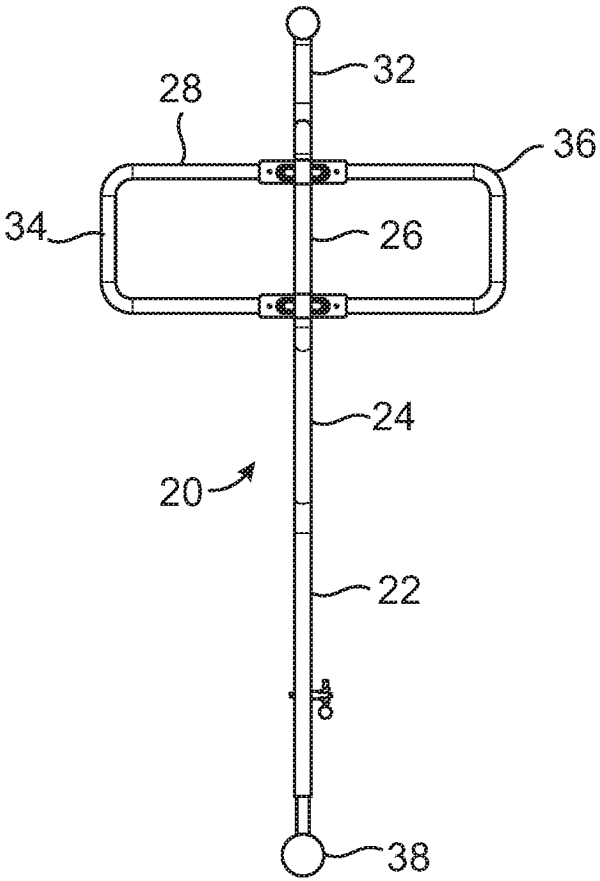
Figure 2A:
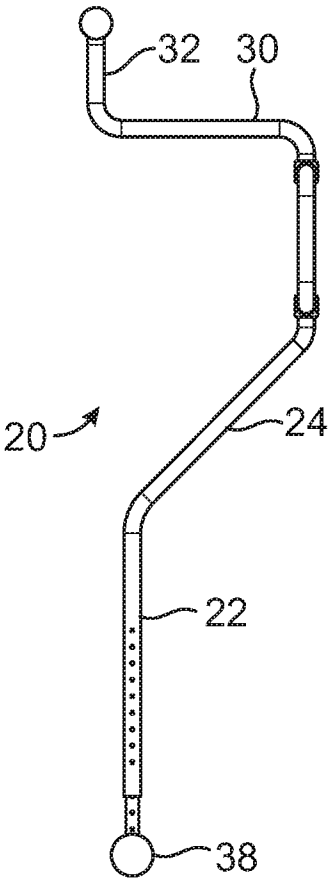

Turning now to FIGS. 2A through 2C, these drawings illustrate a first embodiment of the present invention. The device 20 includes a lower, straight section 22, which may include a tube within a tube to allow for adjusting the length of the straight vertical section 22 depending on the height of the person being helped, as is known from prior art cane devices.

Figure 4A:
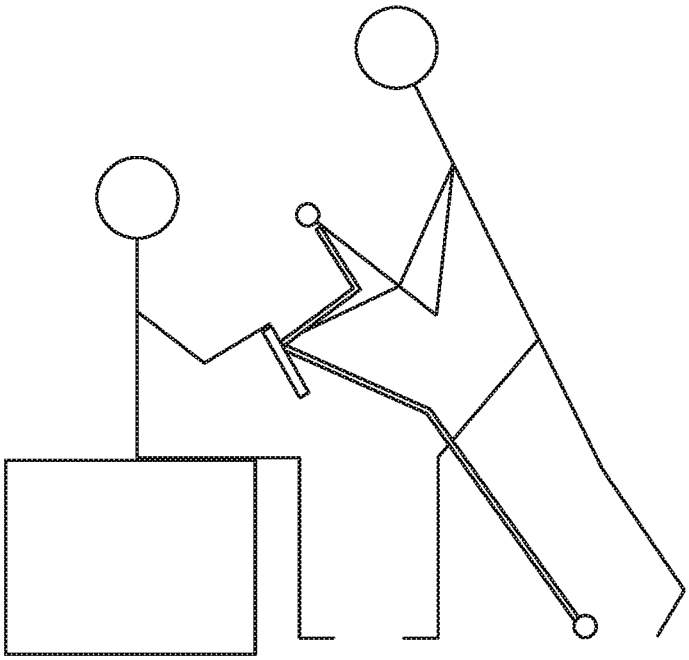
FIGS. 4A and 4B illustrate the method of use of the present invention in an example of moving a person from a seated to a standing position.

Above the section 22 there is shown an offset section 24. The offset section 24 in use is directed towards the person being helped, as shown in FIG. 4A (discussed further below). Above the offset section is an upright section 26 and a lateral support member 28, a further horizontally-disposed member 30 and a final upright member 32. It is to be understood that the terms "vertical" "offset" and "horizontal" are simply convenient ways of describing the device in FIGS. 2A through 2C in the context of the orientations in those drawings.

The lateral support member 28, as illustrated, includes two arms, 34 and 36, which may be gripped by the person seated to provide better lateral stability both when getting up or sitting down. Although the member 28 is shown to be a pair of opposed U-shaped members, it is to be understood that the member may be comprised of other configurations.

Figure 3A:
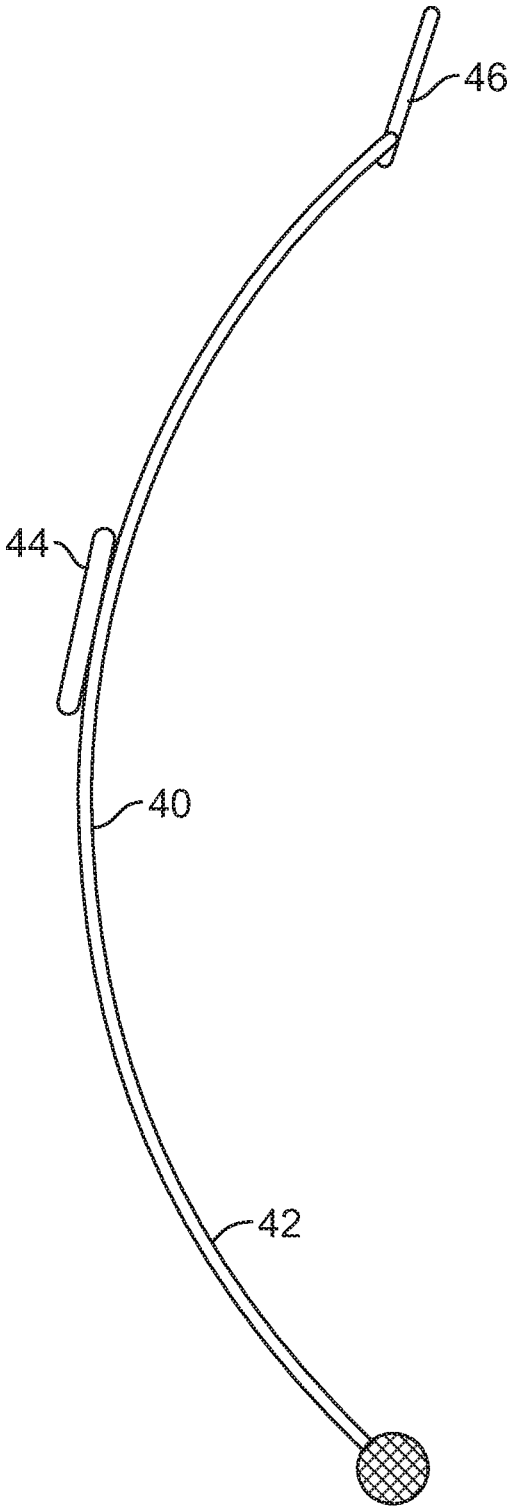
FIGS. 3A and 3B illustrate another embodiment of the device of the present invention.
Figure 3B:
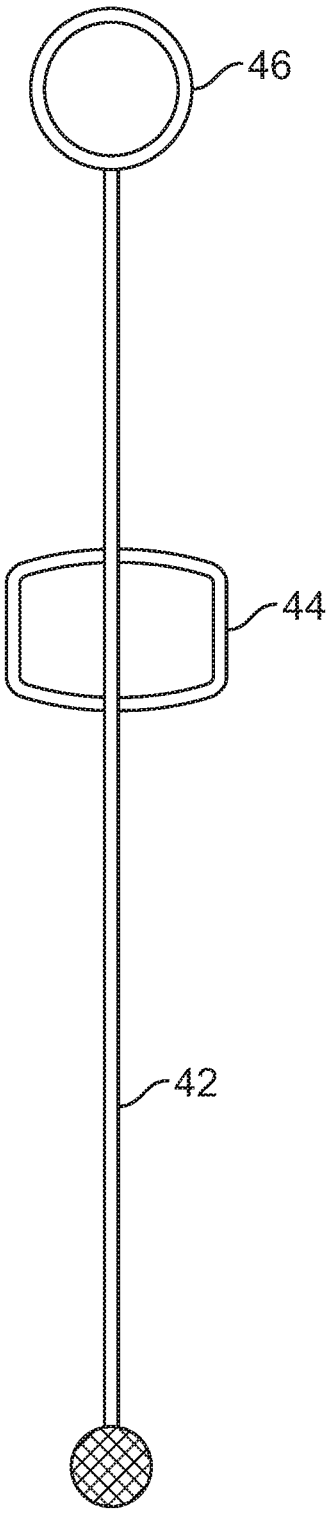

Turning now to FIGS. 3A and 3B illustrate another embodiment of the present invention in which, instead of the offset 24 of FIGS. 2A through 2C, a curved portion 40 of the device 42 provides the force movement advantages of the present invention (to be discussed below in connection with FIGS. 5A to 5C). The device of FIGS. 3A and 3B includes a lateral grip 44 for the seated person and a circular grip 46 for the helper to promote stability. It is understood that the circular grip 46 may be utilized with the device of FIGS. 2*a* through 2C.

Figure 4B:
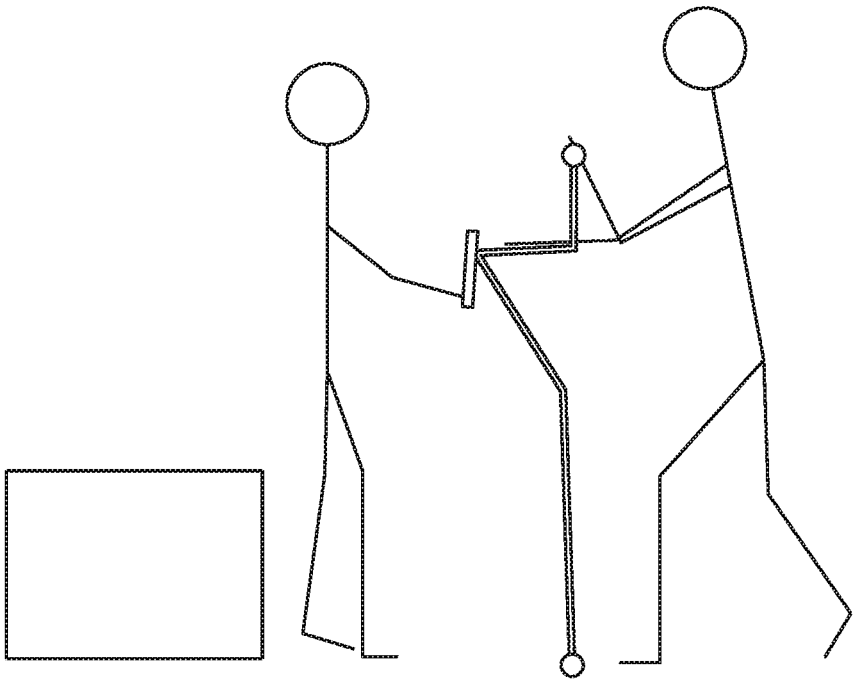

FIGS. 4*a* and 4B illustrate with stick figures the method of use of the device of the present invention, and the positioning of the helper's arms and legs when helping a person/patient to move from the position of FIG. 4A to that of 4B or vice versa (transitioning from the position of 4B to that of 4A).

Figure 5A:
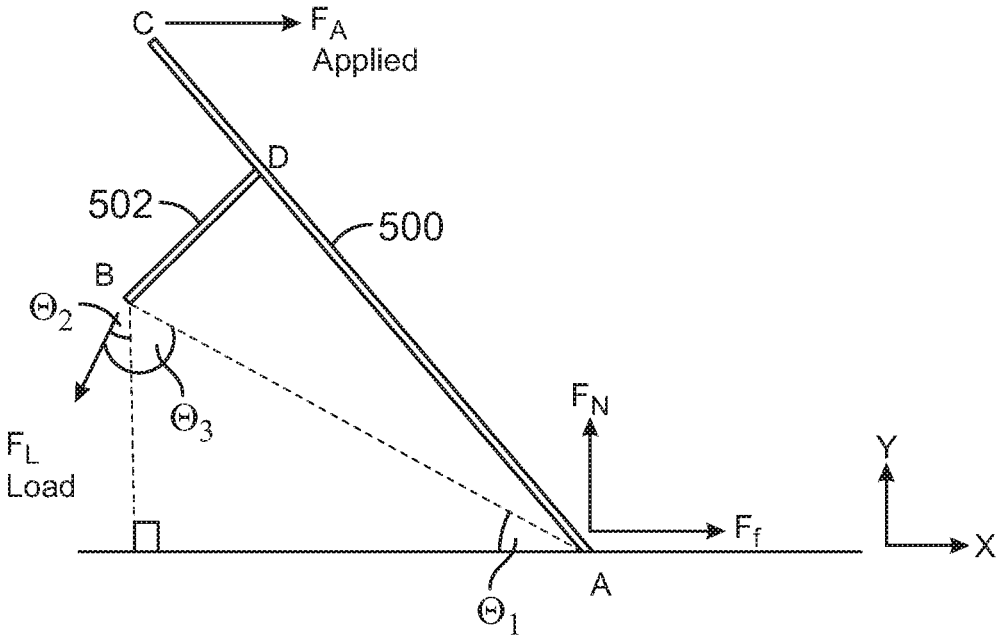
FIGS. 5A and 5B illustrate the force vectors present in the use of the present invention.
Figure 5B:
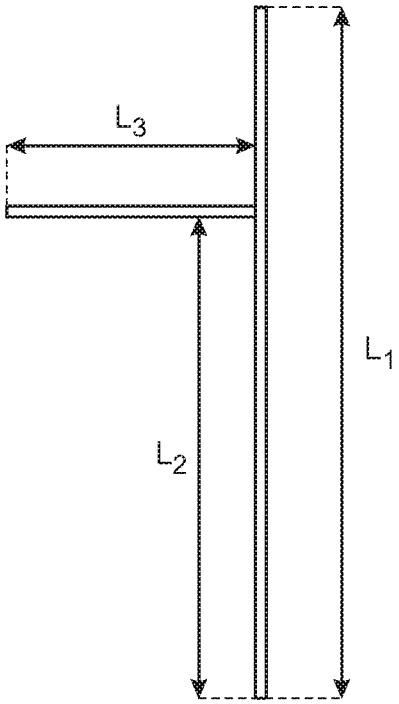

The design of the device of FIG. 5A and FIG. 5B incorporate significant ergonomic advantages to enhance patient and assistant safety during use. The design also provides mechanical advantages over the device of the prior art illustrated in FIGS. 1A and 1B.

Figure 5C:
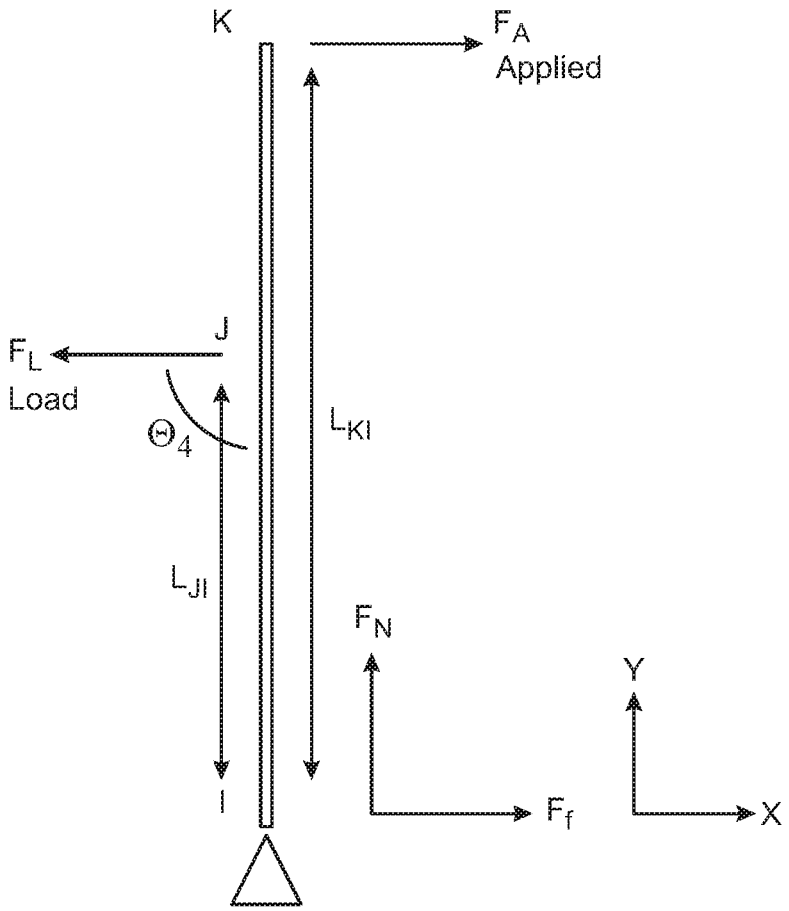
FIG. 5C illustrates the force vectors that come into play with a prior art device.

In the device of the present invention, the horizontal offset transfers more of the applied force to the vertical component of the resisting load, as demonstrated in connection with FIGS. 5A and 5B compared to the prior art of FIGS. 1A and 1B as rendered in FIG. 5C.

The horizontal offset as shown at 502 on the device 500 of FIG. 5A allows the pivot point to be placed forward of the patient's feet to remove the entanglement/tripping hazard in the prior art.

The horizontal offset allows the assistant to start the lifting/assisting maneuver by employing the strongest group of muscles in the human body to generate a thrust motion where the forward leg is planted parallel or ahead of the pivot with knee bent and the upper body, torso and rear leg are aligned back to where the rear foot is placed.

Then, as the force is applied at the upper grip of the device and the helper's front leg is straightened, the helper transfers his/her body weight to their rear leg, using the motion of their center of mass to generate a horizontal momentum. This design greatly reduces the risk of lower back injury to the helper by employing a coordinated and natural motion of the human body to generating force. This sequence can best be seen in FIGS. 4A and 4B, which drawings show the positioning of the helper's body in the sequence from FIG. 4A to FIG. 4B.

The rectangular grip 28 shown in FIGS. 2C and 3B also provides six unique points of contact to accommodate the preference and ability of each person being assisted. These multiple points of grip also allow the helper to grasp the rectangular grip element with one hand while using the other hand at the top of the lever. With the helper utilizing two points of contact that are horizontally off-set, the helper is able to offer resistance to counter any rotational moments that could be induced if the person's load is asymmetrical due to limits in strength and ability. The width of the rectangular grip also allows the breadth of the human shoulder girdle (anatomical term) to exert maximum stabilization of the person by distributing force across that person's upper body naturally. The prior art required the person and helper to each employ an awkward low strength grip on a single vertical axis.

The device of the present invention accounts for a broader range of the human dimension spectrum characterized as the '5% female to the 95% male' in anthropometric design tables. This size accommodation is accomplished by the rectangular grip structure 28 for the upper body width variation and the adjustable telescoping lower section 22 of the device for the variation in upper-body hip-to-shoulder distance and lower-leg ankle-to-knee distance. The sum of these two upper-body and lower-leg variables describes the vertical positioning of the rectangular grip for initiating a lift/assist with a seated patient.

The device of the present invention further allows the device to rotate on its central axis 38 in FIG. 2C as the person goes through the range of motions from sitting to standing then repositioning and going from standing to sitting in an adjacent fixed-chair or wheelchair. Rotation about the axis in combination with the ability of the device to be tilted in the assisting/lifting function is accomplished by one or more interchangeable terminal fixtures with a high coefficient of friction. FIGS. 2A through 2C present, by way of example only, a spherical terminal fixture with a high-friction coating. Other shaped terminal fixtures may be used and are within the scope of the present invention The device of the present invention also allows the attachment of a Gait Belt harness from the central vertical section of the main structural tubing where the rectangular grip is attached. This option allows the lifting/assisting force to be distributed to a Gait Belt worn by the seated person/patient.

The new design accommodates fitting-out with friction enhancing padding on the structural tubing to both improve the friction properties of the surface and simultaneously reduce the likelihood of injury if a patient's face comes into contact with the grip bar 28 or other structural element.

Referring now to FIGS. 5A and 5B, the following indicia are relevant to an explanation of the ongoing forces:

$$\Delta H_B=(L_2)-(\sin\theta L_2-\sin\theta L_3)$$

$$\Sigma F_x=0=F_A+F_f-\sin\theta_2 F_L$$

$$\Sigma F_Y=0=F_N-\cos\theta_2 F_L$$

$$\Sigma M_A=0=-F_A(\sin\theta_1 L_1)+F_L\sin\theta_3\sqrt{(L_2^2+L_3^2)}$$

$$F_A=[F_L\sin\theta_3\sqrt{(L_2^2+L_3^2)}]+(\sin\theta_1 L_1)$$

$$F_{LY}=F_L\cos\theta_2$$

$$F_{LX}=F_L\sin\theta_2$$

where:

$F_f$=force of friction $\Theta_1$=angle between line AB and horizontal $F_N$=normal force $\Theta_2$=angle between load vector $F_L$ and vertical $F_A$=force applied by assistant $\Theta_3$=angle between load vector $F_L$ and line AB $F_L$=force of load (patient) A, B, C, D=points in FIG. 5A $L_1$, $L_2$, $L_3$=lengths in FIG. 5B $\Delta H_B$=change in elevation of point B as lifting/assisting device is rotated about point A during lifting/assisting motion As illustrated in FIGS. 5A & 5B and the associated summations of forces, moving point B away from line AC (by a distance BD) decreases $\Theta_2$. As $\Theta_2$ decreases, the value of cos $\Theta_2$ increases. The offset distance in FIG. 5A from B to D changes the ratio of the vertical and horizontal components of the applied force transferred to the load. As the vertical component of the applied force increases, the horizontal component of the applied force decreases. The offset BD creates more vertical force at B from $F_A$ applied (force created by assistant) when compared to a simple Type 2 lever with no-offset (FIG. 5C) where the forces applied to a single axis can only create simple moments.

Turning now to the prior art device of FIGS. 1A and 1B, the relevant force vectors shown in FIG. 5C are as follows:

$$\Sigma F_x=0=F_A-F_L$$

$$\Sigma F_Y=0=F_N-F_L\cos\theta_4$$

$$\Sigma M_A=0=-F_A L_{IK}+F_L L_{JI}$$

where:

$F_f$=force of friction $\Theta_4$=angle (90°) between load vector $F_L$ and vertical $F_N$=normal force I, J, K=points in FIG. 5C $F_A$=force applied by assistant $L_{JI}$, $L_{KI}$=lengths in FIG. 5C $F_L$=force of load (patient)

FIGS. 6A through 6H illustrate additional views of the device depicted in FIG. 2A through 2C to provide additional disclosure of the present invention.

Thus, it can be seen that the device of the present invention provides many long sought-after improvements in sit-to-stand and stand-to-sit mobility devices compared to the prior art devices. Both the helper and the person being helped will find it makes movement more easily accomplished as well as reducing accidents of the person being helped and less strain on the helper.

The invention claimed is:

1. A method of moving a person from a first, seated position to a second, standing position, with the assistance of a helper, the method comprising the steps of:

providing a lifting/assisting device the lifting/assisting device being comprised of:

a single rigid vertically extended elongated member, the elongated member having a longitudinal axis, a first proximal terminal end and a second distal end, the first proximal terminal end entering in the center of a spherical member which is pivotable and rotatable about the longitudinal axis of the elongated member and further being adapted for positioning on a floor;

an offset section, the offset section being offset from the longitudinal axis a first distance and being located along the elongated member between the first proximal terminal end and the second distal end;

a lateral support member for the person, the lateral support member being positioned on a distal portion of the offset section, the lateral support member being in the form of a rectangular grip; that rectangular grip having its longer sides perpendicular to the longitudinal axis and having areas to be gripped by the person's hand;

a second offset member, the second offset member being of a dimension to approximately match the first distance of the first offset section; and, a grab member positioned distally of the second offset member for use by the helper;

the method comprising:

first, positioning the proximal terminal end of the device on the floor in front of the person to be moved from a seated position, with the offset section being in the direction of the seated person;

next, positioning the helper behind the device, such that the device is positioned between the seated person and the helper;

next, the seated person's two hands grasping the lateral support member at the areas to be gripped on the lateral support member;

next, the helper grasping the grab member with one hand and the rectangular grip with the other to counter rotational moments about the longitudinal axis; and, next, the helper exerting a force to move the elongated member in a direction away from the seated person and pivoting about the first proximal terminal end of the device;

wherein continued movement of the elongated member raises the seated person from a seated position to a standing position.

2. An apparatus configured to assist a helper to move a seated person from a first, seated position to a second, standing position, the apparatus comprising:

a lifting/assisting device, the lifting/assisting device being comprised of:

a single rigid vertically extended elongated member, the elongated member having a longitudinal axis, a first proximal terminal end and a second distal end, the first proximal terminal end entering in the center of a spherical member which is pivotable and rotatable about the longitudinal axis of the elongated member and further being adapted for positioning on a floor;

an offset section, the offset section being offset from the longitudinal axis a first distance and being located along the elongated member between the first proximal terminal end and the second distal end;

a lateral support member for the person, the lateral support member being positioned on a distal portion of the offset section, the lateral support member being in the form of a rectangular grip; that rectangular grip having its longer sides perpendicular to the longitudinal axis and having areas to be gripped by the person's hand;

a second offset member, the second offset member being of a dimension to approximately match the first distance of the first offset section; and, a grab member positioned distally of the second offset member configured for use by the helper with one hand and the rectangular grip with the other to counter rotational moment about the longitudinal axis.

* * * * *